United States Patent [19]

Appelberg

[11] Patent Number: 5,019,748

[45] Date of Patent: May 28, 1991

[54] METHOD FOR MAKING AN ELECTROLUMINESCENT PANEL LAMP AS WELL AS PANEL LAMP PRODUCED THEREBY

[75] Inventor: Gustaf T. Appelberg, Fairfield, Conn.

[73] Assignee: E-Lite Technologies, Inc., Watertown, Conn.

[21] Appl. No.: 374,582

[22] Filed: Jun. 29, 1989

Related U.S. Application Data

[63] Continuation of Ser. No. 940,794, Dec. 12, 1986, abandoned.

[51] Int. Cl.[5] ..... H05B 37/00

[52] U.S. Cl. ..... 315/169.3; 315/219; 313/502; 313/503

[58] Field of Search ..... 315/DIG. 1, DIG. 5, 315/DIG. 4, 219, 260, 299, 169.3; 313/502, 503, 506, 509, 486, 512

[56] References Cited

U.S. PATENT DOCUMENTS

| | | | |
|---|---|---|---|
| 3,421,037 | 1/1969 | Dymon | 313/502 |
| 4,446,048 | 5/1984 | Randy et al. | 313/486 |
| 4,482,841 | 11/1984 | Tikv et al. | 313/503 |
| 4,532,454 | 7/1985 | Abdolla | 313/506 |
| 4,587,462 | 5/1986 | Buhrer | 315/260 |
| 4,634,639 | 1/1987 | Kawai | 313/503 |
| 4,634,934 | 1/1987 | Tohda et al. | 313/503 |
| 4,647,337 | 3/1987 | Simopoulos et al. | 313/502 |
| 4,670,355 | 6/1987 | Matsudaira | 313/503 |

*Primary Examiner*—Michael Razavi

*Attorney, Agent, or Firm*—McCormick, Paulding & Huber

[57] ABSTRACT

The electroluminescent panel is formed by depositing a first high dielectric strength adhesive layer on a transparent conductively coated plastic carrier strip, electrostatically depositing dry phosphor particles onto the first dielectric adhesive layer to form a phosphor particle approximate mono-layer (layer thickness not exceeding largest size particle electrostatically deposited) with particles disposed side-by-side uniformly across the dielectric adhesive layer, curing the dielectric adhesive layer with ultraviolet light through the carrier strip, depositing a second high dielectric constant filler layer on the phosphor particle layer to surround and overcoat the particles and then curing the second dielectric filler layer to embed the phosphor particles in a high dielectric constant matrix. The layers can be applied to and cured on the carrier strip as it continuously moves through a production line. Apparatus for practicing the invention is also disclosed.

18 Claims, 4 Drawing Sheets

3/4

METHOD FOR MAKING AN ELECTROLUMINESCENT PANEL LAMP AS WELL AS PANEL LAMP PRODUCED THEREBY

CROSS REFERENCE TO RELATED APPLICATION

This application is a continuation of patent application Ser. No. 06/960,794, filed Dec. 12, 1986 and now abandoned.

FIELD OF THE INVENTION

The invention relates to electroluminescent panel lamps and methods for manufacturing same. Apparatus for making electroluminescsent panels is also disclosed.

BACKGROUND OF THE INVENTION

U.S. Pat. No. 4,534,743 issued Aug. 13, 1985, to Anthony D'Onofrio and Walter Kitik describes a process for making flexible split-electrode electroluminscent lamps by applying required lamp component layers in succession on a carrier strip which itself becomes part of the lamp. The disclosed process involves depositing a slurry of uncured epoxy resin and electroluminescent phosphor particles on a transparent conductive coating (indium-tin oxide) previously applied to a transparent flexible insulating carrier strip (Mylar® strip) The slurry coated strip is passed through a curing oven to cure the epoxy resin to bond the phosphor particulate in a flexible matrix and to adhere it to the coated carrier strip. Then, a slurry of liquid-borne conductive particulate is continuously deposited on the cured strip and the slurry dried to provide a second continuous coating of electrically conductive material; e.g., a nickel-filled acrylic coating. The laminated panel is then subjected to the split-electrode forming steps described in the patent.

U.S. Pat. No. 4,449,075 issued May 15, 1984 to Anthony D'Onofrio and Jack Gunzy, and U.S. Pat. No. 4,532,395 issued July 30, 1985 to Raymond Zukowski, involve an electroluminescent lamp driver circuit and an electroluminescent flexible touch switch panel, respectively.

Other prior art workers have used a slightly different process to manufacture individual electroluminescent lamps one at a time on a non-continuous basis (i.e., not using a continuously moving carrier strip), wherein the slurry of binder resin or material and electroluminescent phosphor particles is deposited on a piece of aluminum foil which functions in the lamp as the back or rear electrode. A transparent front electrode is placed over the dried phosphor layer on the back electrode and front leads and buss bar are attached to it to form the electroluminescent lamp. A dielectric layer is applied to the transparent front electrode on the side facing the deposited phosphor layer.

The slurry deposition process for depositing the phosphor particles suffers from disadvantages such as difficulty in obtaining uniform coverage of the substrate by the phosphor and stacking of phosphor particles atop one another. Non-uniform phosphor coverage results in voids in the phosphor layer. Increased voltage in driving lamps is required when voids are present in the layer. Stacking of phosphor particles in the layer increases the layer thickness. The buried phosphor particles absorb voltage without contributing to light output and also result in the lamp requiring more driving voltage. In general, the slurry process is difficult to control.

U.S. Pat. No. 2,728,870 describes a process for increasing light output of an electroluminescent lamp by heating the cured resin/phosphor layer after deposition on a substrate to the melting temperature of the resin while subjecting the heated layer to a D.C. electric field to impart a common alignment to the phosphor particles after cooling of the layer.

Technical article entitled "High Brightness Electroluminescent Lamps of Improved Maintenance" published by R. J. Blazek in *Illuminating Engineering*, November, 1962, provides information on construction of electroluminescent lamps and factors affecting their brightness or light output.

Similarly, a technical article entitled "Lasers, EL, and Light Values" published in *Display Systems Engineering*, pp. 379–391, 1968, discusses factors which affect performance of electroluminescent lamps.

SUMMARY OF THE INVENTION

The present invention provides a method for making an electroluminescent panel lamp wherein electroluminescent phosphor particles are deposited electrostatically from a phosphor particle batch typically containing various particle sizes; e.g., 5 micron to 38 micron, onto a substrate such as the front or rear electrode of the panel with thickness controlled to provide a phosphor deposit thickness no larger than the largest size phosphor particulate in the batch. The largest particles are deposited generally side-by-side with substantially uniform coverage of the substrate. Such deposition method provides a phosphor particle layer that is thin, being an approximate mono-layer; i.e., a layer whose thickness does not exceed the largest size phosphor particulate in the batch, with such largest particles disposed substantially side-by-side without stacking of large particles atop one another and disposed substantially uniformly thereacross and requires less driving voltage while optimizing light output of each particle.

The present invention also provides a method for making an electroluminescent panel wherein the phosphor particulate layer is deposited on a first dielectric layer applied on a front or rear electrode or member of an electroluminescent panel and wherein the deposited phosphor particles are covered on the opposite side from the first dielectric layer with a second dielectric adhesive or filler layer applied to the phosphor particles to fill interstitial voids between adjacent particles and to overcoat the particles. The first and second dielectric layers can be curable using ultraviolet (U.V.) or other radiation.

The present invention also provides a method for making an electroluminescent panel wherein a reflective metallic layer or member is vapor deposited on a dielectric layer that has a smooth surface finish to provide a highly reflective rear electrode or member of the lamp as a result of the high smoothness (high gloss) of the dielectric surface on which it is deposited and the high purity of the metallic layer as vapor deposited.

The method contemplated by the present invention can be carried out in a continuous fashion by the steps described above using a continuously moving carrier strip which becomes part of the electroluminescent panel or lamp.

In accordance with a typical working embodiment of the invention for continuous manufacture, a transparent flexible carrier strip of insulating plastic material with a first thin transparent electrically conductive coating or layer thereon, such as indium-tin oxide, is moved past a first adhesive depositing device for depositing on the conductive coating a first transparent high dielectric strength radiation-curable adhesive and past a source of dry phosphor particulate with the first dielectric adhesive layer facing the source and in the presence of an electrostatic field to electrostatically deposit an approximate mono-layer (layer whose thickness does not exceed the largest size particulate) of phosphor particulate side-by-side uniformly on the first adhestive layer. The electrostatically deposited dry phosphor particulate has substantially 100% density across the surface of the first adhesive layer in that substantially the only voids present are interstitial in nature between the side-by-side largest particles as a result of irregularities in phosphor particle shapes. Phosphor particulate of smaller size can fill or deposit into the interstitial voids between the largest particles of the layer. Following deposition of the phosphor particulate layer, the carrier strip passes an ultraviolet lamp to cure the first adhesive layer through the transparent carrier strip; i.e., the U.V. lamp is placed on the side of the carrier strip opposite from the deposited phosphor particulate layer such that the U.V. light passes through the carrier strip and transparent conductive coating thereon to reach the first adhesive layer.

The carrier strip with the cured first dielectric layer and deposited phosphor particulate layer adhered thereto is next moved past another or second adhesive depositing device to deposit a second transparent high dielectric constant radiation-curable adhesive or filler on the adhered phosphor particulate layer to fill interstitial voids between the phosphor particles and overcoat the particles on the side opposite from the first adhesive layer to a selected thin depth of overcoat. The carrier strip is then passed by another ultraviolet lamp to cure the second dielectric layer directly; i.e., the lamp is placed on the same side of the carrier strip as the second dielectric layer with U.V. light impinging directly on the second dielectric adhesive layer. The first and second cured dielectric layers embed or encapsulate the phosphor particles in a thin high dielectric constant matrix as required for high efficiency operation of the electro-luminescent panel lamp.

Following curing of the second dielectric layer as described above, the carrier strip is passed by a device that vapor deposits a thin metallic layer, such as aluminum, on the second dielectric layer to provide a highly reflective rear electrode that may be split in accordance with the teachings of U.S. Pat. No. 4,534,743. The smoothness of the vapor deposited rear electrode layer can be controlled by controlling smoothness or gloss of the second cured dielectric adhesive layer to provide significantly increased reflectivity of light from the rear to the front of the lamp in operation. The carrier strip can be coiled after the lamp layers are formed thereon for subsequent pay-out in a production line that die cuts lamp shapes from the coil and splits the rear electrode. Attachment of electrical lead lines to the split rear electrode can then occur.

The electroluminescent panel lamp of the invention produced by the above-described process is thin, preferably having a total thickness of first dielectric, phosphor layer and second dielectric of about 0.0020 inch or less, and has improved light output without increasing driving voltage.

The invention also contemplates apparatus for making an electroluminescent panel on a substantially continuous basis using a moving carrier strip and using either an electrostatic deposition device for high volume lamp production or a slurry deposition device for low volume production. The slurry deposition device can be used in the apparatus alternately as the second dielectric depositing device described above by connecting the device to a reservoir of second dielectric material in lieu of connection to a reservoir of slurry.

The above objects and advantages of the present invention will be better understood by reference to the following drawings and description of best mode for practicing the invention.

BEST MODE FOR PRACTICING THE INVENTION

Figure 1:
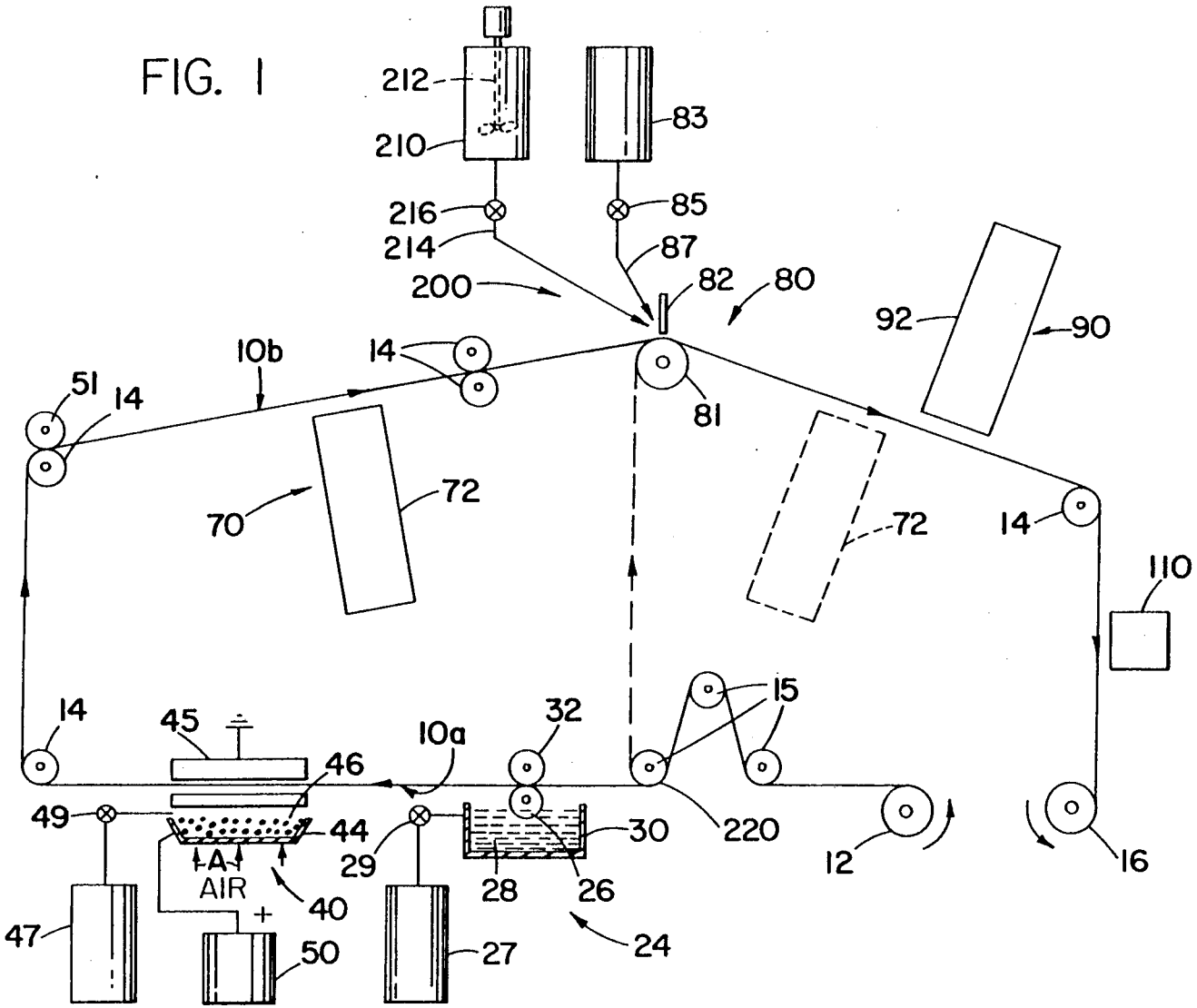
FIG. 1 is a schematic illustration of apparatus for continuously making the electroluminescent panel lamp of the invention.

The preferred forms of the process of the invention and resulting electroluminescent panel are shown in FIG. 1 and FIGS. 2A through 2E. In FIG. 1 there is provided a continuous carrier strip 10 of transparent insulating material which is conveniently stored on a payoff roll 12. Means are provided to uncoil the carrier strip from roll 12 and drive it through a series of guide and strip alignment rolls 14 and tension adjustment and control rolls 15 and strip alignment means (not shown but of known construction) and ultimately to coil the strip on take-up roll 16 at the other end of the line. A conventional motor drive (not shown) continuously moves the carrier strip 10 at a substantially continuous speed which may be selected in the range of about 10–20 feet per minute. The carrier strip 10 of transparent insulating material is preferably Mylar, a registered trademark of E. I. duPont de Nemours and Co., preferably having a thickness of about 5 mils ( 0.005 inch). The width of the Mylar carrier strip 10 may be in the range of 24 inches to 60 inches and have a typical length of 500 to 900 feet.

Figures 2A, 2B, 2C, 2D, 2E:
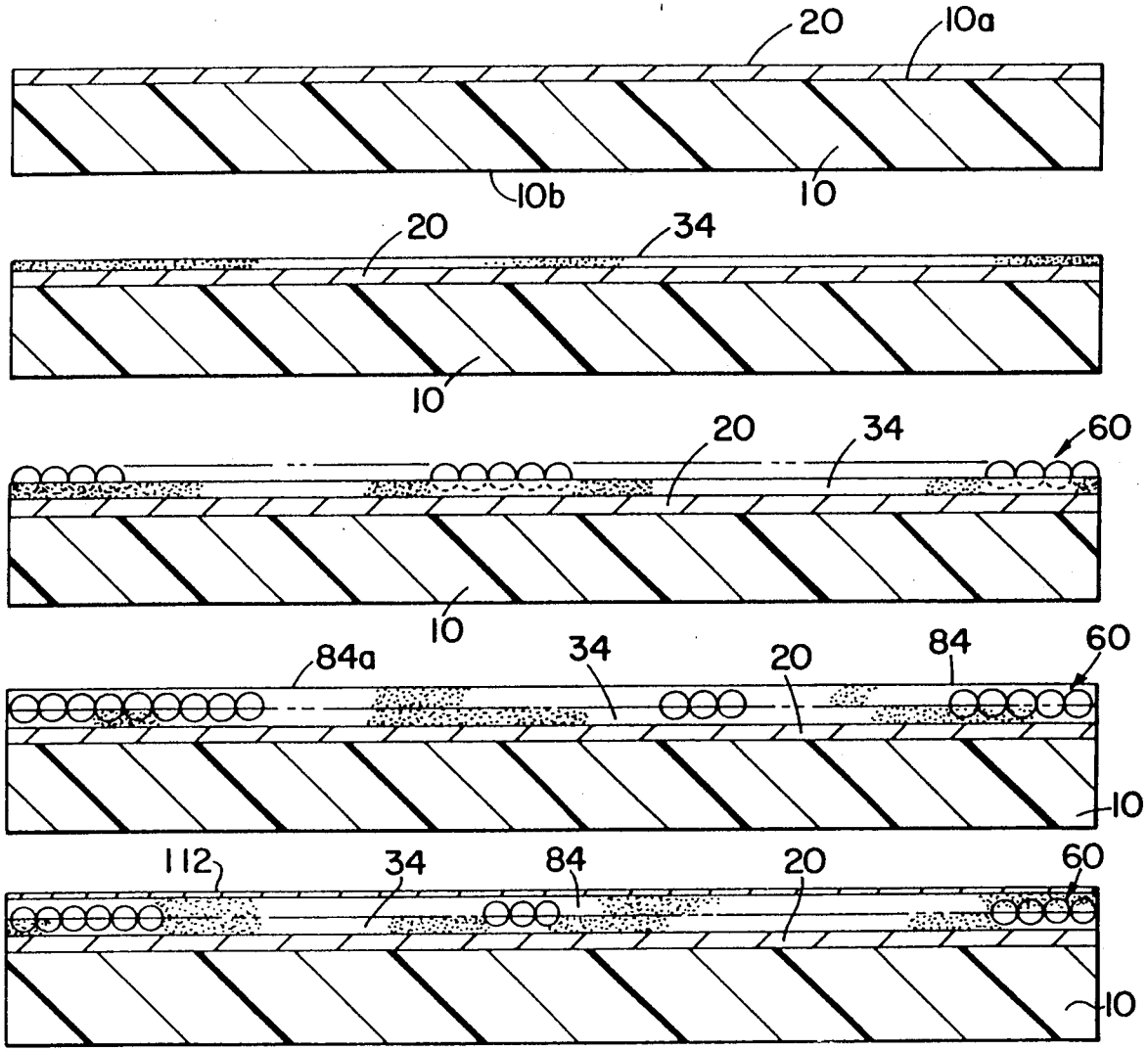
FIGS. 2A–2E are a series of somewhat schematic cross-sections through the width of the laminated electroluminescent panel lamp as the operative layers are added on one another.

A first continuous thin transparent coating 20 of electrically conductive material is provided, for example by sputtering, on side 10*a* of the carrier strip 10, FIG. 2A. The conductive coating 20 may be indium-tin oxide having a thickness of about 400 Angstroms. Mylar strip with such a transparent conductive coating is commercially available in strip form under the name of "Intrex", a registered trademark of Sierracin Corporation.

Typical coated Mylar strip thickness is about 5 mils ( 0.005 inch).

Carrier strip 10 moves continuously from payoff roll 12 past adhesive applying device or station 24 with the side a facing downwardly in FIG. 1 toward adhesive applying roll 26 which picks up liquid radiation-curable dielectric adhesive 28 from container 30 for application as a thin layer 34 on the conductive coating 20 on side 10*a* by rolling contact between side 10*a* and roll 26. An upper biasing roll 32 insures contact between side 10*a* and adhesive applying roll 26. An adhesive reservoir 27 supplies adhesive to container 30 as controlled by control metering valve 29. The adhesive device 24 is of the rotogravure type and provides precise control of the thickness of the thin transparent adhesive deposit or layer 34 on conductive coating 20. A typical thickness for first adhesive layer 34 is about 0.3–0.5 mils (0.0003–0.0005 inch). First adhesive layer 34 (as cured) is a high dielectric strength adhesive such as, for example, Magnacryl UV2601 Epoxy available commercially from Beacon Chemical, 125 MacQuesten Parkway, Mount Vernon, N.Y. 10550. Such adhesive has a high dielectric strength of about 2200 volts per mil of thickness. At a 0.3 mil layer thickness, first dielectric adhesive layer 34 (as cured as described hereinbelow) provides about 660 volts protection to conductive coating 20 and the rear electrode to be described which voltage value is greater than three times the voltage to be applied to the lamp to operate same. Adhesive layer 34 is applied in liquid form (viscosity of 700 CPS) to conductive coating 20 and is curable subsequently by radiation; e.g., ultraviolet light of selected wave length as will be described.

The carrier strip 10 with conductive coating 20 and first uncured dielectric adhesive layer 34 thereon is shown in FIG. 2B. The total thickness of the lamp layers at this point in fabrication is the aggregate of 0.005 inch for strip 10 and coating 20 plus 0.0003–0.0005 inch for first dielectric adhesive layer 34.

The adhesive depositing device 24 useful in the practice of the invention is known commercially as "Chartpak Coater" available from Magnat Corp., North Maple Street, Florence, Mass. 01060.

The carrier strip 10 with conductive coating 20 and first uncured dielectric adhesive layer 34 is then moved continuously past the phosphor particulate depositing device or station 40 which includes a phosphor source such as a fluidized bed or batch 46 of dry phosphor particulate of particle size preferably not exceeding 400 mesh (38 micron diameter) for the zinc sulfide particles used. The phosphor particulate is purchased from GTE Corporation in batches not to exceed 400 mesh which corresponds to sieve opening of 38 microns. Of course, such batches include phosphor particles of size less than 38 microns. For example, particle sizes down to 5–6 microns are present in such batches and are referred to herein as "fines" or "tailings". It is significant to control the mesh size of the phosphor particulate used in the invention as the preferred thickness of the phosphor layer is controlled to coincide with that of the largest phosphor particulate present in the batch or bed 46. Of course, it may be possible to use electroluminescent phosphor particulate other than zinc sulphide and of other sizes although phosphor particles of about 50 microns or less diameter (or largest dimension) are preferred with about 400 mesh (38 micron) particulate being most preferred. As shown best in FIG. 1, the fluidized bed 46 includes a sintered metal pan 44 in which the dry phosphor particulate 46 is disposed and fluidized by air flow A from beneath.

In addition to fluidized bed 46, the phosphor particulate depositing device 40 includes means for establishing an electrostatic field between the carrier strip and pan 44 so that the phosphor particulate is electrostatically deposited on or attracted to first uncured adhesive layer 34 which faces the pan 44. In particular, the pan 44 is connected to a voltage source 50 to make the pan positive (e.g. 45,000 volts) relative to the carrier strip which is held at ground potential by contact with grounded guide rollers 14 and also by contact with an aluminum grounding plate 45 located directly above the phosphor particulate source 46. A suitable electrostatic phosphor depositing device for the invention is available commercially from Electrostatic Technologies Corp., 80 Hamilton Street, New Haven, Conn. 06511.

Reservoir 47 contains phosphor particulate of 400 mesh and provides particulate to bed 46 as metered by conventional valve 49.

Figure 3:
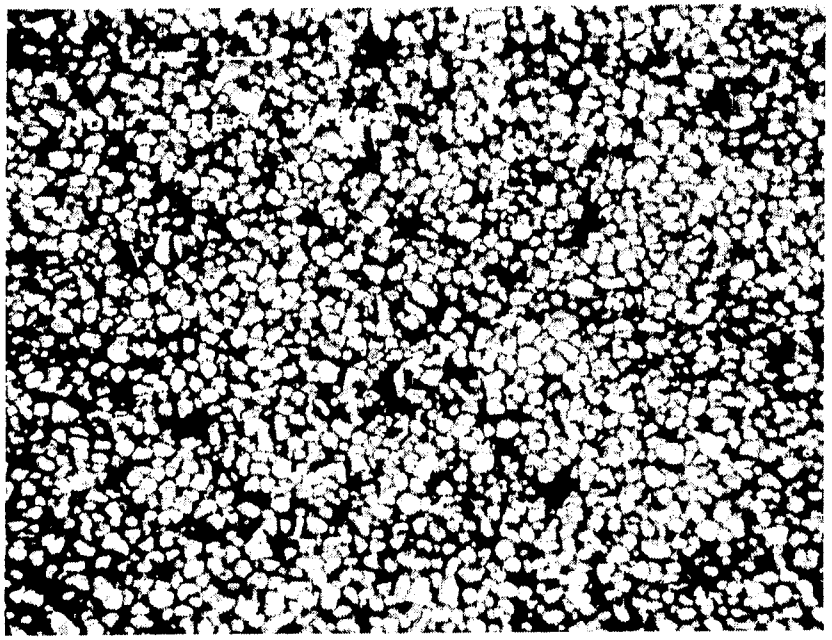
FIG. 3 is a photomicrograph at 50X of the electrostatically deposited phosphor particulate mono-layer showing side-by-side postioning of the phosphor particles uniformly across the first dielectric adhesive layer after curing of the latter with U.V. light.

As a result of electrostatic deposition of the charged phosphor particulate 46 on the first uncured dielectric adhesive layer 34 on grounded carrier strip 10, the phosphor particles are deposited in an approximate mono-layer 60; i.e., a layer whose thickness does not exceed the thickness or diameter of the largest particle in bed 46 without substantial large particle stacking on top of one another but instead with the larger phosphor particles positioned substantially side-by-side in a plane parallel with the plane of the carrier strip uniformly across and embedded substantially into the first uncured dielectric adhesive layer 34, see FIG. 3. As is apparent, phosphor particulate mono-layer 60 extends uniformly across the first adhesive layer with near 100% surface density except for interstitial voids between the side-by-side particles resulting from their different shapes or profiles from one particle to the next as is apparent. Smaller size particles (tailings) are deposited and lodge between the large size particles during the electrostatic deposition process.

The substantially 100% phosphor particle density on the first adhesive layer 34 is apparent. Importantly, the thickness of near mono-layer 60 is equivalent to the thickness of the largest phosphor particles present in bed 46 or about 0.0015 inch (38 microns) in thickness. Embedding of the phosphor particles aided by roll 51 (teflon coated and height adjustable) is substantial such that the aggregate thickness of adhesive layer 34 and embedded phosphor particulate layer 60 is considered about 0.0016 inch. The thinness of the near mono-layer 60 and aggregate thickness of layers 34 and 60 allow conductive coating 20 and the rear electrode to be described to be spaced apart closely to one another so as not to require excessive voltage to drive the lamp and eliminates stacking of the largest particles one atop the other.

Furthermore, since the zinc sulfide phosphor particles may exhibit some polarity individually, the orientation of the electrostatically deposited phosphor particles of the mono-layer 60 will be similarly oriented from one particle to the next relative to the plane of the carrier and will increase lamp efficiency, light output and light output consistency across the lamp face during operation.

In lieu of a fluidized bed, the phosphor source 46 could include a rotatable positive polarity transfer wheel (not shown) which receives dry phosphor particulate from a phosphor particulate bed or reservoir and rotates at a desired speed in spaced depositing relation to side 10*a* to electrostatically deposit the near mono-layer 60 of phosphor particulate on side 10*a*.

Following electrostatic deposition of the phosphor particulate layer 60, the carrier strip is moved continuously past curing device or station 70 comprising an ultraviolet lamp 72. Lamp 72 is disposed on side 10*b* of the carrier strip which is opposite to side 10*a* on which coating 20, first adhesive layer 34 and phosphor mono-layer 60 are deposited in succession. Lamp 72 is selected to have a power and wave length to cure first dielectric adhesive layer 34 from side 10*b* with the ultraviolet light passing through the Mylar strip and conductive coating 20 to reach layer 34 to cure same. To cure first adhesive layer 34 described above, an ultraviolet lamp known as a "D" lamp commercially available from Fusion Systems Corp., 7600 Standish Place, Rockville, Md. 20855 has been found useful. Lamp 72 cures transparent first adhesive layer 34 in a rapid manner as the carrier strip passes by the lamp at the 10–20 feet per minute line feed. The cured dielectric adhesive layer 34 holds the phosphor particulate mono-layer 60 thereon as the carrier strip is moved to the next adhesive filler depositing device or station 80.

Depositing device or station 80 preferably is a known knife-over roller depositor having roll 81 and knife 82 closely adjacent carrier side 10*a* to form a thin radiation curable adhesive or filler layer 84 on the phosphor layer 60 and around the particles thereof as adhesive or filler is fed from reservoir 83 by metering valve 85 in supply 87. Such a knife-over roller deposition is available from Magnat Corp., North Maple Street, Florence, Mass. 01060.

A typical thickness for second dielectric adhesive or filler layer 84 is at least about 0.0003 inch above phosphor particulate mono-layer 60, FIG. 2D. However, second adhesive or filler layer 81 also penetrates and fills the interstitial voids between the side-by-side phosphor particles to surround and cover the particles. The second adhesive layer 84, when cured, embeds or encapsulates the phosphor particles in a high dielectric constant flexible matrix that exhibits a low moisture absorption and transmission rate. Thus, second transparent adhesive or filler layer 84 (as cured as described hereinbelow) is a high dielectric constant adhesive such as, for example, Magnacryl UV 7632 Epoxy available commercially from Beacon Chemical referred to above or Epoxy 301-2 available from Epoxy Technology, Inc. Such adhesive or filler as cured has a high dielectric constant of about 8 or greater to promote increased storage of electrostatic energy and higher lamp output.

Second or filler adhesive 84 is applied in liquid form (viscosity of 700 CPS) to phosphor particulate layer 60 to fill the interstitial voids and overcoat and is curable subsequently by radiation; e.g., ultraviolet light of selected power and wave length as will be described.

When cured at curing station or device 90 by movement of the carrier strip therepast, the second adhesive or filler layer 84 also provides a smooth outer surface 84*a* facing away from the mono-layer 60 for receiving a metallic rear electrode 112 as will be described. For example, second adhesive or filler layer 84, when cured, has a surface gloss on surface 84*a* of preferably about 50–60, 60° Gardner (i.e., smoothness of the cured surface 84*a* is measured by gloss using a Gardner glossmeter that shines light at a 60° angle on the surface). The reflection is measured on a scale of 0–100 with 0 being the least smooth and 100 the most smooth.

Curing station or device 90 comprises an ultraviolet lamp 92 of a power and wave length to cure second uncured adhesive or filler layer 84 as the light is directed directly on to the layer 84 from side 10*b* of the carrier strip. To cure the layer 84 described above, an ultraviolet lamp known as an "H" lamp commercially available from Fusion Systems Corp. referred to above has been found useful.

After curing second adhesive or filler layer 84 to embed the approximate mono-layer 60 in the flexible first and second layers 34, 84 functioning as a dielectric matrix, the carrier strip 10 can be moved through a metallic deposition apparatus 110 for vapor deposition of a thin reflective metallic conductive layer 112 on to surface 84*a* of the cured second dielectric layer 84. A typical metallic layer 112 would comprise vapor deposited aluminum with a thickness of about 300 Angstroms. As mentioned above, the vapor deposited layer 112 will interface with high gloss smooth surface 84*a* and as a result of this interface and its higher vapor deposited purity provides a highly light reflective conductive rear electrode layer 112 that enhances the light output of the lamp. The aluminum layer 112 may be vapor deposited by well known conventional techniques.

As will be explained, the rear reflective electrode metallic layer 112 will be split to form a pair of side-by-side electrodes in accordance with U.S. Pat. No. 4,534,743, the teachings of which are incorporated herein by reference.

In lieu of having the metallic deposition apparatus 110 in series alignment with the other components of the production line of FIG. 1, the apparatus 110 could be omitted and located elsewhere for depositing the layer 112 on surface 84*a*. In such a case, carrier strip 10 would be coiled on take-up roll 16 after ultraviolet curing of second adhesive dielectric layer 84. The coil would be transferred to the metallic deposition apparatus and uncoiled to pass through the apparatus 110 and recoiled after passing therethrough. Aluminum deposition for the purposes of this invention are available from Web Technologies, 27 Main Street, Oakville, Conn. 06002 and Scharr Industries, 40 E. Newberry Road, Bloomfield, Conn. 06002.

After vapor deposition of the aluminum layer 112, the total thickness of the carrier strip and all the layers thereon comprising the electroluminscent panel described above will be about 0.007 inch.

Figure 4:
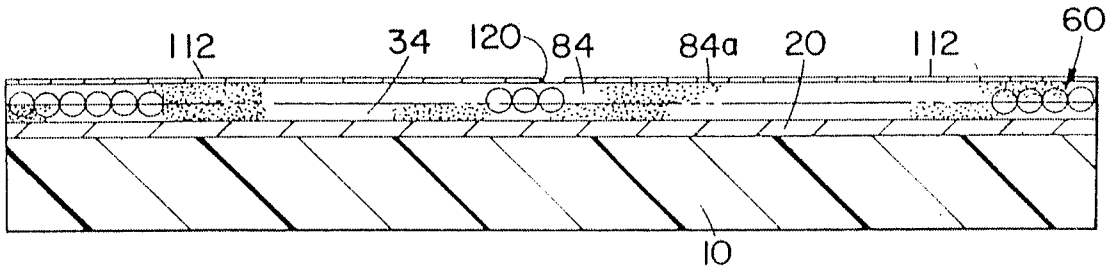
FIG. 4 is a cross-sectional view through the electroluminescent panel lamp with the rear aluminum electrode split.
Figure 5:
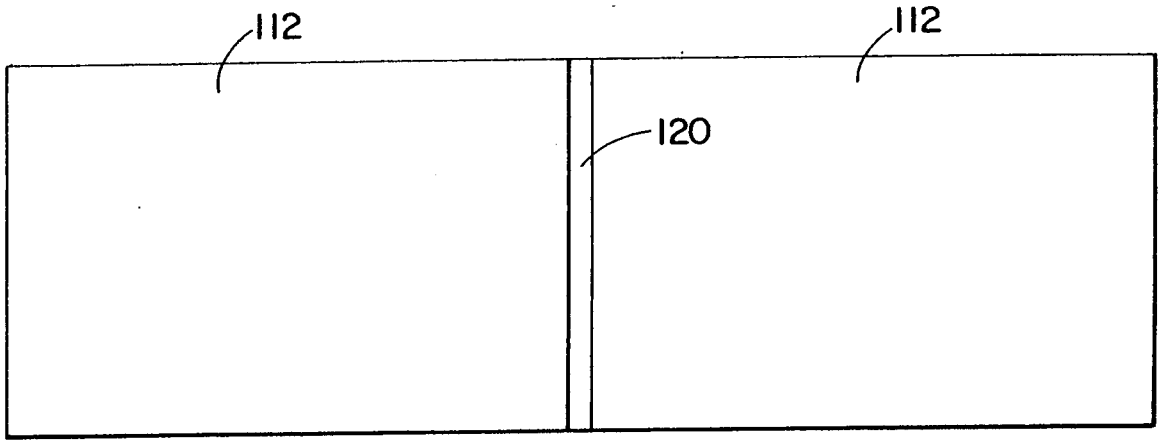
FIG. 5 is a plan view of a completed electroluminescent lamp.

FIG. 4 and FIG. 5 show the electroluminescent panel or strip 10 after complete processing in accordance with the invention and with the rear metallic reflective electrode layer 112 split at groove 120 in accordance with the aforementioned U.S. Pat. No. 4,534,743.

Figure 6:
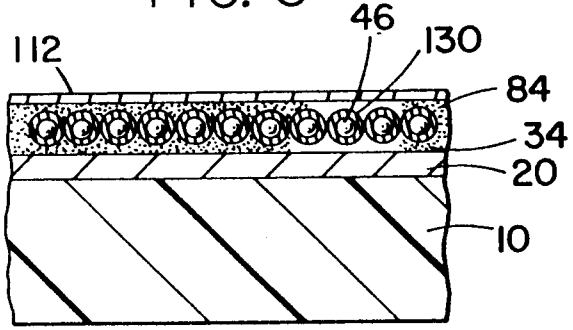
FIG. 6 is a view similar to FIG. 2E for another embodiment of the invention before a heating step to meld shells 130 together.

FIG. 6 illustrates another embodiment of the invention which differs from the embodiment described hereinabove in that the dry phosphor particles are each micro-encapsulated in a high dielectric constant layer or shell 130 prior to loading in pan 44. The encapsulating material will be an optically clear material having extremely high resistance to moisture penetration. The encapsulated phosphor particles would be deposited electrostatically on to the first uncured adhesive layer 34 as in the above embodiment as an approximate mono-layer with the encapsulated phosphor particles disposed side-by-side substantially uniformly across the first adhesive layer. Following electrostatic deposition, an additional step of heating the deposited encapsulated phosphor mono-layer at relatively low temperature corresponding to a temperature at which layer or shell 130 flows, softens or becomes tacky to flow the mono-layer into a more or less unitary mass that would reduce voids that the second adhesive or filler layer 84 must fill. Similar first and second dielectric layers 34, 84 may be used. The encapsulating layer 130 could be a radiation curable or heat curable material. The remainder of the process would not otherwise change in character.

Those skilled in the art will appreciate that although dry phosphor particulate deposited electrostatically has been described hereinabove, it may be possible to employ wet electrostatic deposition from liquids or slurries, so long as the near or approximate mono-layer 60 is deposited uniformly across the substrate with thickness not exceeding the largest size phosphor particulate in the batch.

Although the invention has been described hereinabove in connection with a continuous process using a moving carrier strip, it is apparent that the process does not need to be continuous in nature although continuous operation is preferred.

The apparatus for making an electroluminescent panel described hereinabove with respect to FIG. 1 is advantageous for large volume production of the panels.

For small production volume of electroluminescent panels, the apparatus includes optional slurry depositing device 200 for use in conjunction with the knife-over roller depositor 80. The optional device or equipment comprises a slurry reservoir 210 for a slurry of phosphor particles in uncured epoxy binder and a mixer 212 for maintaining a uniform as possible distribution of phosphor particulate in the slurry.

A slurry supply 214 conveys the slurry to the knife-over roller deposition 80 as controlled and metered by conventional valve 216.

In this mode of operation of the apparatus, the carrier strip 10 is diverted at roller 220 directly to the knife-over edge deposition 80 as shown in dashed lines "D".

At the knife-over roller depositor 80, adhesive flow control valve 87 is shut off so that only slurry from reservoir 210 is controllably fed to depositor 80. The slurry is deposited onto the conductive coating 20 of the Mylar carrier strip 10 as it moves therepast. Following depositor 80, the as-deposited phosphor slurry is then cured first from the bottom (10*b*) by U.V. lamp 72 which is movable to the position shown in phantom for operation of the apparatus in this mode and then cured from the top (side 10*a*) by U.V. lamp 92. This curing sequence is preferred to insure a fully cured layer. Any suitable means may be used to move lamp 72 to the phantom position shown. The phosphor slurry applied in this mode is preferably of the type described in the aforementioned U.S. Pat. No. 4,534,743, the teachings of which are incorporated by reference. The phosphor slurry is thus a slurry of uncured epoxy resin and phosphor particles (400 mesh) having a viscosity of 10,000 CPS. Preferably, the epoxy component of the slurry is epoxy known commercially as "Magnacryl UV 2632", referred to hereinabove.

Once the slurry is cured by lamps 72, 92, the carrier strip is fed past the aluminum depositor 110 or the strip is coiled and sent to a vendor for depositon of aluminum layer 112 on the side of the cured slurry layer opposite from the conductive layer 20 to form a lamp panel strip which can be further processed to form a finished lamp.

While there has been described in the foregoing specification the best and preferred mode for carrying out the invention as well as one modification thereof, I intend to cover in the appended claims all modifications thereof as full within the spirit and scope of the invention as set forth in the appended claims.

I claim:

1. Apparatus for making an electroluminescent panel comprising:

first dielectric depositing means for depositing a first dielectric layer on a conductive layer of a carrier strip moving therepast, wherein said first dielectric depositing means is of the rotogravure type and said second dielectric depositing means is a knife-over roller depositor;

means for depositing a mono-layer of phosphor particulate on said first dielectric layer as said carrier strip moves therepast wherein said phosphor particulate mono-layer has a thickness no greater than the largest phosphor particle deposited in said phosphor particulate mono-layer;

first radiation curing means adjacent said carrier strip and located intermediate said phosphor particulate mono-layer depositing means and said second dielectric depositing means;

second dielectric depositing means for depositing a second dielectric layer on said phosphor particulate mono-layer as said carrier strip moves therepast, and means for moving said carrier strip past each of said first dielectric, said phosphor particulate mono-layer and said second dielectric depositing means, respectively.

2. The apparatus of claim 1 further including means for vapor depositing a reflective, electrically conductive layer on said second dielectric layer as said carrier strip moves therepast.

3. The apparatus of claim 1 further including second radiation curing means following said second dielectric depositing means.

4. The apparatus of claim 1 wherein said phosphor particulate mono-layer depositing means includes electrostatic depositing means having a phosphor source that has an electrically positive potential relative to an electrical potential associated with said carrier strip.

5. Apparatus as defined in claim 1 wherein said phosphor particulate mono-layer depositing means comprises electrostatic depositing means.

6. An electroluminescent panel, said panel comprising:

a transparent insulating member;

a first electrically conductive layer on said member, said first conductive layer being transparent;

a first dielectric layer adjacent said first conductive layer, said first dielectric layer being transparent;

a mono-layer of phosphor particulate adjacent said first dielectric layer, said phosphor particulate mono-layer having interstitial voids between adjacent particles comprising said phosphor particulate;

a second dielectric layer adjacent said phosphor particulate mono-layer wherein said interstitial voids are substantially filled, said second dielectric layer overcoating said phosphor particles to embed them in a dielectric matrix, said second dielectric layer being transparent, and a second electrically conductive layer adjacent to said second dielectric layer;

said second dielectric layer further forming a smooth surface on the side of said phosphor particulate mono-layer opposite said insulating member;

said second electrically conductive layer further being a vapor deposited aluminum on said smooth surface of said second dielectric layer.

7. An electroluminescent panel, said panel comprising:

a transparent insulating member;

a first electrically conductive layer on said member, said first conductive layer being transparent;

a first dielectric layer adjacent said first conductive layer, said first dielectric layer being transparent;

a mono-layer of phosphor particulate adjacent said first dielectric layer, said phosphor particulate mono-layer having interstitial voids between adjacent particles comprising said phosphor particulate;

a second dielectric layer adjacent said phosphor particulate mono-layer wherein said interstitial voids are substantially filled, said second dielectric layer overcoating said phosphor particles to embed them in a dielectric matrix, said second dielectric layer being transparent, and a second electrically conductive layer adjacent to said second dielectric layer;

said second dielectric layer further forming a smooth surface on the side of said phosphor particulate mono-layer opposite said insulating member;, said second electrically conductive layer further being disposed on said smooth surface of said second dielectric layer and reflective to light.

8. The panel of claim 7 wherein said first electrically conductive layer is indium-tin oxide.

9. The panel of claim 7 wherein said first dielectric layer is a high dielectric strength epoxy.

10. The panel of claim 7 wherein the thickness of said first dielectric layer is about 0.003–0.005 inch.

11. The panel of claim 7 wherein said phosphor particulate mono-layer is an electrostatically deposited layer embedded in said first dielectric layer.

12. The panel of claim 7 wherein said second dielectric layer is a high dielectric constant epoxy.

13. The panel of claim 7 wherein said second dielectric layer overcoats said phosphor particulate mono-layer to a thickness of at least about 0.003 inch.

14. The panel of claim 7 wherein said phosphor particulate mono-layer is electrostatically deposited adjacent said first dielectric layer.

15. Apparatus for making an electroluminescent panel, said apparatus comprising:

first dielectric depositing means for depositing a first dielectric layer on a conductive layer of a carrier strip moving therepast;

electrostatic depositing means for depositing a mono-layer of phosphor particulate on said first dielectric layer as said carrier strip moves therepast;

second depositing means for alternatively depositing a second dielectric layer on said phosphor particulate mono-layer as the strip moves therepast from said electrostatic depositing means or depositing a mono-layer of phosphor particulate slurry on said conductive layer of said carrier strip as said carrier strip moves therepast while by-passing said first dielectric and said electrostatic depositing means, and means for moving said carrier strip past each of said first dielectric, said electrostatic and said second dielectric depositing means, respectively when said second depositing means deposits said second dielectric layer or for by-passing said first dielectric and said electrostatic depositing means respectively and moving said carrier strip directly past said second depositing means when it deposits said mono-layer of phosphor particulate slurry, said second depositing means including a reservoir for dielectric material comprising said second dielectric layer and another reservoir for said phosphor particulate slurry and valve means for alternatively supplying said dielectric material or said phosphor particulate slurry to said second depositing means, said first and second depositing means further including a knife-over roller depositor alternatively receiving said dielectric material or said phosphor particulate slurry.

16. The apparatus of claim 15 further including a movable first radiation curing means adjacent on e side of said carrier strip, and a second radiation curing means adjacent to the other side of said carrier strip and disposed downstream of said second depositing means.

17. Apparatus for making an electroluminescent panel, said apparatus comprising:

first dielectric depositing means for depositing a first dielectric layer on a conductive layer of a carrier strip moving therepast;

electrostatic depositing means for depositing a mono-layer of phosphor particulate on said first dielectric layer as said carrier strip moves therepast;

second depositing means for alternatively depositing a second dielectric layer on said phosphor particulate mono-layer as the strip moves therepast from said electrostatic depositing means for depositing a mono-layer of phosphor particulate slurry on said conductive layer of said carrier strip as said carrier strip moves therepast while by-passing said first dielectric and said electrostatic depositing means, and means for moving said carrier strip past each of said first dielectric, said electrostatic and said second dielectric depositing means, respectively when said second depositing means deposits said second dielectric layer or for by-passing said first dielectric and said electrostatic depositing means, respectively and moving said carrier strip directly past said second depositing means when it deposits said mono-layer of phosphor particulate slurry, said first radiation curing means being movable from a position downstream of said first depositing means and upstream of said second depositing means when said second dielectric material is being deposited to a position downstream of said second depositing means when said phosphor particulate slurry is being deposited.

18. Apparatus as defined in claim 10 wherein said phosphor particulate mono-layer depositing means comprises electrostatic depositing means.

* * * * *